United States Patent [19]

Imamura et al.

[11] 4,436,600

[45] Mar. 13, 1984

[54] METHOD FOR TREATMENT OF COPPER ANODES TO BE ELECTROREFINED

[75] Inventors: Tatsuo Imamura, Tokyo; Mitsuo Katoh, Ibaraki, both of Japan

[73] Assignee: Nippon Mining Co., Ltd., Tokyo, Japan

[21] Appl. No.: 478,769

[22] Filed: Mar. 25, 1983

[30] Foreign Application Priority Data

Mar. 25, 1982 [JP] Japan ..... 57-46218

[51] Int. Cl.[3] ..... C25R 1/12

[52] U.S. Cl. ..... 204/140; 204/108; 204/106; 148/13.2

[58] Field of Search ..... 148/13.2; 204/106–108, 204/130, 140

[56] References Cited

U.S. PATENT DOCUMENTS 2,976,192 3/1961 Saarivirta et al. ..... 148/13.2

*Primary Examiner*—R. L. Andrews

*Attorney, Agent, or Firm*—Sughrue, Mion, Zinn, Macpeak & Seas

[57] ABSTRACT

An anode for copper electrolysis is given improved dissolving activity and enhanced ability to curb the phenomenon of passivation by a cooling treatment which is carried out at a cooling speed of from 20° C./hour to 400° C./hour to at least 400° C., preferably to 200° C.

7 Claims, 3 Drawing Figures

METHOD FOR TREATMENT OF COPPER ANODES TO BE ELECTROREFINED

FIELD OF THE INVENTION

The present invention relates to a method for the treatment of copper anodes to be electrorefined, and more specifically to a method for thermally treating the copper anodes for the purpose of enhancing their dissolution activity during electrorefining practice.

BACKGROUND OF THE INVENTION

In general, increasing the current density in the electrolytic refining of copper anodes results in an increased copper production through-put without the need for the extra capital investment. Steam and manpower requirements per unit production capacity may also be reduced.

However, increasing the current density gives rise to the following adverse effects: (1) power requirement per unit production capacity conversely increases, (2) surface roughness of electrodeposited copper cathodes increases, and (3) the contamination of copper product with harmful impurities such as Sb, As and Bi tends to become more pronounced. Nonetheless, operating the tankhouse at current densities as high as one can go yet remains to be important in increasing the through-put of electrorefined copper cathodes, provided some appropriate technical measure can be taken to eliminate the aforementioned disadvantages.

The optimum current density to give the maximum economy in the electrorefining of copper has been reported to be 836 $A/m^2$ as obtained using a copper electrolyte containing 0.5 M $CuSO_4$ and 1.5 M $H_2SO_4$ (60° C.). However, actual working current densities employed at most refineries are limited to levels considerably lower than the optimum current density (i.e., 200 to 250 $A/m^2$), partly because the surface roughness of electrodeposited copper cathodes tends to increase with increasing Au and Ag losses. In addition, most commercial anodes can hardly withstand such high current density and are readily passivated.

It is also true that the current distribution widely spreads in the tankhouse due to plumbing error, irregular electrode spacing and variation in the weight of anodes with time, etc., thus making some area of the tankhouse operate at current densities much higher than the average current loading, which can cause the onset of passivity.

In order to prevent anodes from passivating during electrorefining exercise, there have been suggested the adoption of the following measures: (1) lowering the current density, (2) increasing electrolyte temperature, (3) intensifying electrolyte circulation, and (4) properly selecting composition of the copper electrolyte along with the kind and amount of organic additives to be employed. The industry has long awaited a new method for effectively preventing the passivation of copper anodes.

A major object of the present invention, therefore, is to provide a method for the treatment of copper anodes to be electrorefined which makes it possible for electrolysis to be advantageously carried out at a high current density without passivation and which generates a significant increase in the output of copper without requiring any additional equipment.

Another object of this invention is to provide a method for the treatment of copper anodes to be electrorefined, which makes it possible for electrolysis to be advantageously carried out without passivation even when levels of impurities are extremely high in the copper anode.

SUMMARY OF THE INVENTION

The present inventor conducted various studies relating to methods for the treatment of copper anodes to be electrorefined and consequently ascertained that subjecting the anode to proper thermal treatment is effective in preventing passivation of the anode. This invention has been perfected on the basis of this knowledge.

Specifically, this invention relates to a method for the treatment of copper anodes which is characterized by heating the anode to 600° C. to 1,050° C. (preferably 600° C. to 800° C.) followed by cooling it at a rate of from 20° C./hour to 400° C./hour (preferably 120° C./hour to 250° C./hour).

The other objects and characteristic features of the present invention will become apparent from the description to be given herein below in further detail with reference to the accompanying drawings.

DETAILED DESCRIPTION OF THE INVENTION

Figure 1:
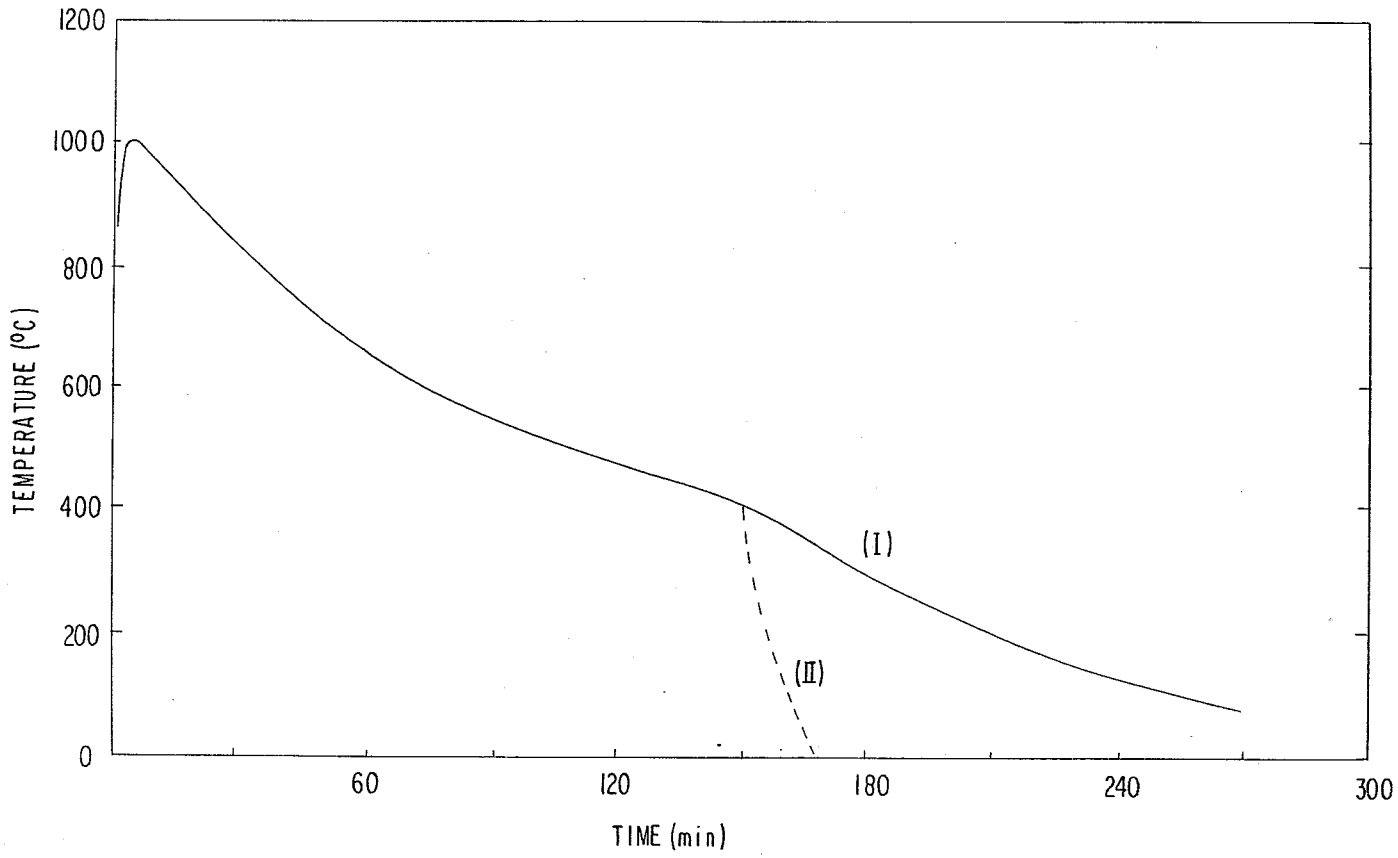
FIGS. 1 through 3 are diagrams illustrating cooling curves obtained by the method of this invention for the treatment of copper anodes to be electrorefined.

The expression "copper anodes" as used in this invention refers to an anode which is refined during the process of copper smelting and cast with a rotary casting machine or continuous casting machine (such as, for example, a Hazelett casting machine (made in Hazelett Strip Casting Corp.)).

To carry out the present invention, the anode for copper electrolysis is cast, cooled off and then heated to a temperature in the range of 600° C. to 1,050° C. Otherwise, the "hot"anode freshly taken out of the casting machine (which is estimated to have a temperature of from 600° C. to 800° C.) may be subjected to subsequent thermal treatment.

The question as to which of the two methods described above should be adopted may be suitably determined with consideration to the convenience of available equipment and the particular process used.

The anode which has been heated to a temperature of 600° C. to 1,050° C., preferably 600° C. to 800° C., by either of the two methods described above is cooled (gradually) at a relatively slow cooling speed of from 20° C./hour to 400° C./hour, preferably 120° C./hour to 250° C./hour.

The effectiveness of this cooling treatment in the prevention of passivation increases proportionally as the aforementioned cooling speed decreases. If the cooling speed decreases below 20° C./hour, however, the time required for the cooling treatment becomes too long for the treatment to be practicable in terms of productivity and equipment. If the cooling speed exceeds 400° C./hour, the cooling treatment is not effective enough to completely eliminate the incidence of passivation to occur.

The cooling treatment is carried out at the aforementioned cooling speed until the anode reaches a temperature of 400° C., preferably 200° C. The anode is then subjected to a quenching treatment which cools it off spontaneously outside the oven. Of course, the anode may be allowed to cool off to room temperature at the aforementioned cooling speed. The effectiveness of the cooling treatment is not appreciably affected by the post treatment.

The effectiveness of this invention in the prevention of passivation can be easily rated by measuring the time of passivation (tp) as described below.

The aforementioned time of passivation (tp) is defined as the duration existing between the time the electrolysis is started and the time the anode potential rises sharply.

The effect of the cooling treatment in preventing passivation, i.e., the copper anodes to be electrorefined gain in dissolving activity, increases in an amount proportional to the increase in passivation time.

During the cooling treatment, the anode must be covered with a blanket of an inert gas such as argon or nitrogen in order to prevent the anode surface from excessive oxidation in the course of the cooling. Where the aforementioned inert gas is not readily available, the cooling treatment may be advantageously carried out with the anode placed as much in a closed container as possible. Then, 20% by volume of the oxygen contained in the air entrapped within the container is consumed in the oxidation of the anode surface. The actual amount of the oxygen thus consumed is not large enough to oxidize the anode surface excessively. The remaining gas in the container is mostly nitrogen gas. The treatment in this container, therefore, proceeds substantially under a blanket of nitrogen gas.

The cooling treatment is carried out in a batchwise process as described above. Otherwise, it may be continuously carried out with a tunnel type container or oven.

As is clear from the foregoing description and also from the working examples to be cited herein below, this brings about the following effects in making the electrolysis of copper undergo advantageously:

(1) The electrolysis of copper can be carried out at a high current density and can be expected to warrant a significant increase in the output of copper.

(2) The cooling treatment can be effectively performed even for anodes with their impurity levels being extremely high.

(3) Cell voltage and slime fall can be lowered so much as to encourage economization of power consumption and reduction in cost of the subsequent slime treatment.

(4) The incidence of electrical short circuiting to occur due to passivation is reduced, which facilitates the maintenance of the electrolytic cells and reduces labor costs.

The present invention will now be described more specifically below with reference to working examples of the invention. However, the invention is not limited to these examples.

EXAMPLE 1

Copper anodes from four different sources were used here. The chemical compositions of these anodes were as shown in Table 1. Two small test pieces were cut from these anode samples. The anode samples had widely varying impurity distributions. The test pieces measured 5×10×1.5 cm. One set of these small test pieces were untreated while the other set of small test pieces were preparatorily heated to 1,000° C. and then subjected to a cooling treatment performed according to the curve (I) of FIG. 1 under a blanket of nitrogen gas. The cooling speed in the aforementioned cooling treatment was 220° C./hour on the average.

TABLE 1

| | Chemical Composition (in ppm) | | | | | | | | | | | |
|---|---|---|---|---|---|---|---|---|---|---|---|---|
| Anode | O | Ni | Pb | As | Sb | Se | Te | S | Fe | Bi | Sn | Ag |
| A | 1,000 | 250 | 50 | 86 | 50 | 335 | 17 | 15 | 18 | 3 | 24 | 225 |
| B | 1,400 | 930 | 1,350 | 45 | 120 | 80 | 10 | 5 | 15 | 10 | 40 | 215 |
| C | 1,700 | 340 | 170 | 690 | 120 | 540 | 30 | 100 | 15 | 180 | 30 | 540 |
| D | 3,300 | 600 | 1,000 | 640 | 250 | 165 | 50 | 40 | 10 | 36 | 20 | 930 |

It was confirmed by analysis that the anodes had substantially the same chemical compositions before and after the above described cooling treatment.

A pair of anodes, one with thermal treatment and the other without, were electrolyzed for 24 hours at a conventional current density of 200 A/m$^2$ in a standard copper electrolyte containing 40 g/liter Cu, 20 g/liter Ni, and 200 g/liter $H_2SO_4$ and kept at a temperature of 50° C. to form a slime layer of a quasisteady stated thickness. Then, the anode was left open circuit for 1 hour. Using the same electrolytic solution, the anode was subjected to electrolysis at an increased current density of 400 A/m$^2$ to determine the time of passivation (tp). The results are shown in the following Table 1 (a).

TABLE 1 (a)

| | Time of Passivation (in minutes) | |
|---|---|---|
| Anode | Before Cooling Treatment | After Cooling Treatment |
| A | 14 | 96 |
| B | 17 | 120 |
| C | 18 | 145 |
| D | 1 | 88 |

It is noted from Table 1 (a) that irrespective of the kind of anode the cooling treatment equally brought about remarkable increase in the dissolution activity to such an extent that none of these anodes can be passivated if electrolyzed under the ordinary electrorefining conditions.

EXAMPLE 2

The same four copper anodes as used in Example 1 were cooled according to the curve (I) of FIG. 1 until their temperature fell to the neighborhood of 400° C. Then, they were released from the oven and allowed to air cool (the curve (II) of FIG. 1).

The thus thermally treated anodes, together with the untreated ones, were then dissolution tested in exactly the same way as per described in Example 1. The results were as shown in the following Table 1 (b).

TABLE 1 (b)

| Anode | Time of Passivation (in minutes) Before Cooling Treatment | After Cooling Treatment |
|---|---|---|
| A | 14 | 67 |
| B | 17 | 110 |
| C | 18 | 105 |
| D | 1 | 44 |

Although the lengths of time of passivation obtained by the cooling treatment in this example were shorter than those obtained by the cooling treatment of Example 1, they were conspicuously greater than those of the anodes before the cooling treatment. These results indicate that the cooling treatment of this example suffices for practical purposes.

EXAMPLE 3

Figure 2:
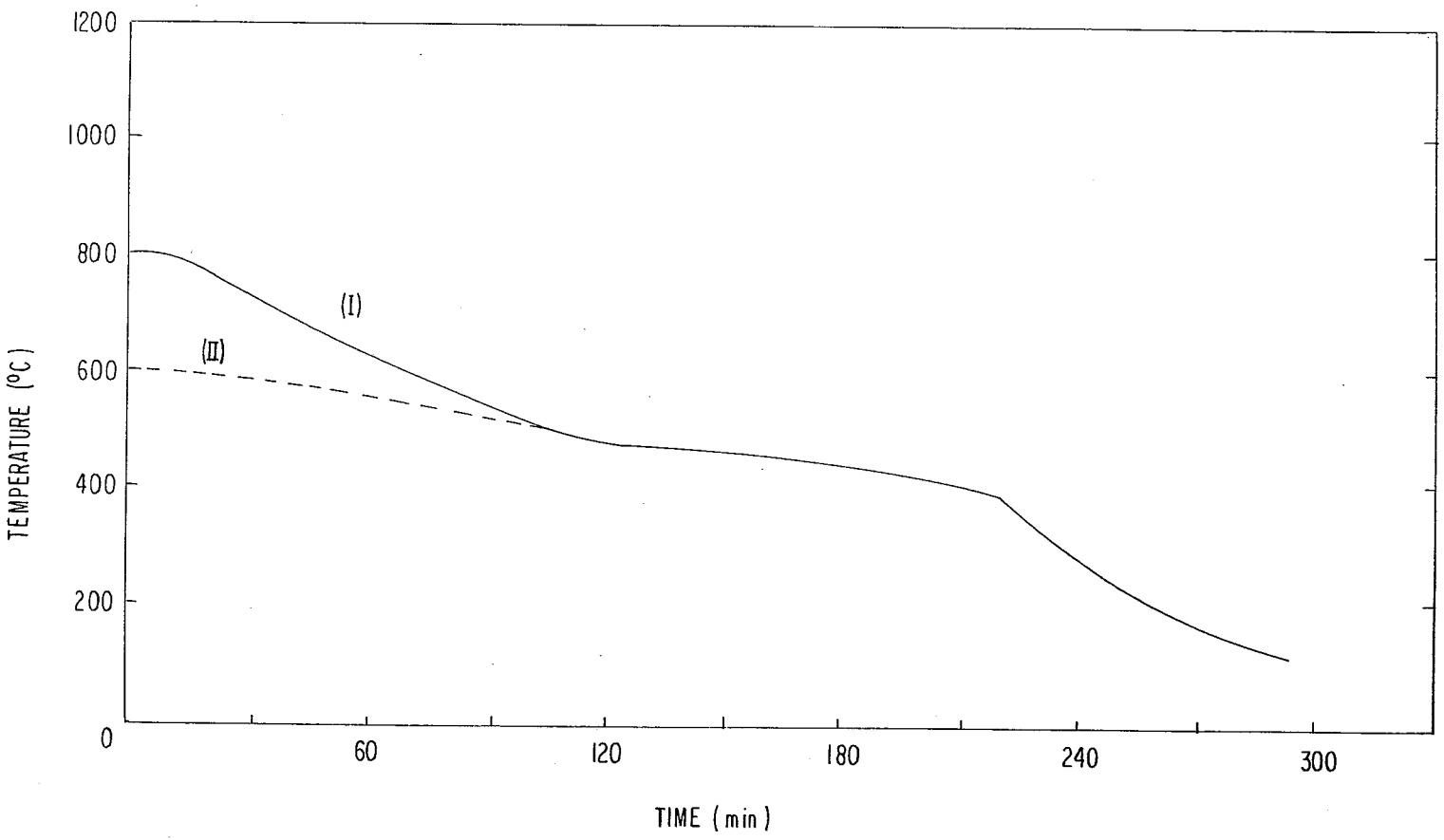

Anode C for copper electrolysis shown in Table 1 was cast, removed from the mold, and then subjected, while still hot, to a cooling treatment. In the case of a sample which was cooled from 800° C. to 200° C., the cooling speed was fixed at 120° C./hour (curve (I) of FIG. 2). In the case of a sample which was cooled from 600° C. to 200° C., the cooling speed was fixed at 80° C./hour (curve (II) of FIG. 2).

The anodes, both with and without the cooling treatment, were subjected to the same electrolysis carried out in Example 1 to determine the time of passivation. The results were as shown in the following Table 1 (c).

TABLE 1 (c)

| Anode | Time of Passivation (in minutes) Before Cooling Treatment | Cooled from 600° C. | Cooled from 800° C. |
|---|---|---|---|
| C | 18 | 80 | 150 |

It is noted from Table 1 (c) that the length of time of passivation was conspicuously greater after the cooling treatment than before the treatment and that the ratio of increase of the time of passivation was higher when the cooling treatment was started at a higher temperature than when it was started at a lower temperature.

EXAMPLE 4

Figure 3:
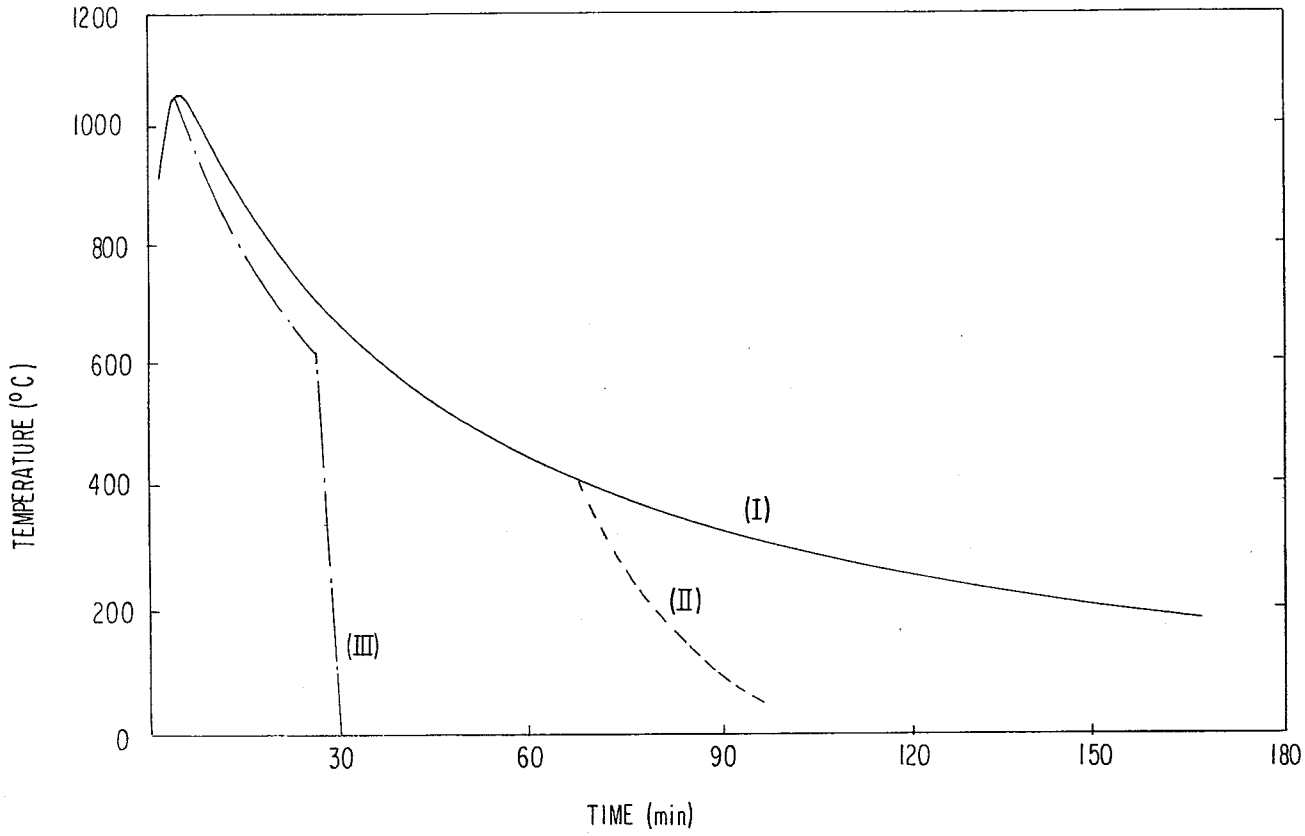

Small test pieces (5×10×1.5 cm) of an anode for copper electrolysis having a comparatively high arsenic content (containing 1,210 ppm of As, 110 ppm of Bi, 260 ppm of Sb, 520 ppm of Ni, 540 ppm of Se, 100 ppm of S, 170 ppm of Pb, and 540 ppm of Ag) were heated to 1,050° C. and then subjected to cooling treatments at different rates according to the cooling curves shown in FIG. 3.

The curve (I) of FIG. 3 represents a cooling treatment performed at a cooling speed of 400° C./hour to 200° C., the curve (II) a cooling treatment performed at a cooling speed of 400° C./hour to 400° C. and followed by spontaneous cooling within the oven, and the curve (III) corresponds to conventional molding/cooling mode as practiced in most copper refineries.

The anode samples which had undergone the cooling treatments mentioned above were then subjected to electrolysis in the same manner as already described in Example 1 to determine the time of passivation. The results were as shown in the following Table 1 (d).

TABLE 1 (d)

| Type of Treatment | | Time of Passivation (in minutes) |
|---|---|---|
| Curve (III): | No treatment | 14 |
| Curve (II): | Cooling + standing | 20 |
| Curve (I): | Cooling | 27 |

From the data, it may be safely concluded that the cooling treatment increases the time of passivation and tends to enhance the dissolving activity but that the cooling treatment cannot be expected to bring about any conspicuous effect when the cooling speed is excessively high.

EXAMPLE 5

By remelting the anode C for copper electrolysis shown in Table 1 and adding varying amounts of arsenic to two aliquots of the molten anode, there were obtained test pieces (5×10×1.5 cm) having arsenic contents of 0.30% and 0.63%, respectively.

These test pieces were subjected to a cooling treatment according to the curve (I) of FIG. 1.

By following the procedure of Example 1, the two anode samples which had undergone the cooling treatment were measured for passivation time.

The results of passivation time measurement are shown in Table 2 in comparison with the results obtained of the anode not enriched with arsenic and of the anode enriched with arsenic but not yet subjected to the cooling treatment.

Table 2 also shows data of the adhesiveness of slime onto the surface of an aged copper anode as well as cell voltage after five days of electrolysis.

It is noted from Table 2 that by the cooling treatment of this invention, (1) the trend of an anode of high arsenic content toward passivation is lightened, (2) the cell voltage is lowered, (3) the adhesion of a slime layer to the surface of aged anode is improved, and (4) the amount of slime fall is lowered.

TABLE 2

| As Content in Anode (%) | Cooling Treatment | Time of Passivation (tp) (minute) | Cell Voltage (v) | Amount of Slime Fall (kg/t-Cu) | Slime* Held on Aged Anode Surface (%) |
|---|---|---|---|---|---|
| 0.069 | Before | 18 | 0.290 | 2.78 | 84.2 |
| | After | 105 | 0.251 | 2.16 | 90.5 |
| 0.30 | Before | 18 | 0.144 | 5.06 | 56.5 |
| | After | 70 | 0.138 | 4.86 | 76.3 |
| 0.63 | Before | 32** | 0.189 | 9.47 | 12.5 |
| | After | 62 | 0.185 | 7.37 | 26.6 |

*Based on the amount of produced anode slime taken as 100%.

**Theoretically, this value ought to have been not more than 20 minutes. This high value may be explained by the fact that the slime layer only poorly adhered to the surface of this particular anode and continuously fell off, so that the diffusion of $Cu^{2+}$ ions across the thin layer was rather smooth.

While the invention has been described in detail and with reference to specific embodiments thereof, it will be apparent to one skilled in the art that various changes and modifications can be made therein without departing from the spirit and scope thereof.

What is claimed is:

1. A method for preventing passivation of cast copper anodes during electrorefining, comprising the steps of:

providing copper anodes to be electrorefined;

heating the anodes to a temperature within the range of 600° C. to 1,050° C.; and cooling the anodes at a cooling rate within a range from 20° C./hour to 400° C./hour.

2. The method for preventing passivation of cast copper anodes during electrorefining as claimed in claim 1, wherein the anodes are cooled at a cooling rate of 20° C./hour to 400° C./hour to a temperature of 400° C.

3. The method for preventing passivation of cast copper anodes during electrorefining as claimed in claim 1, wherein the anodes are cooled at a cooling rate of 20° C./hour to 400° C./hour to a temperature of 200° C.

4. The method for preventing passivation of cast copper anodes during electrorefining as claimed in claim 1, wherein the cooling rate is about 220° C./hour on the average.

5. The method for preventing passivation of cast copper anodes during electrorefining as claimed in claim 1, wherein the cooling is carried out in an inert gas atmosphere.

6. The method for preventing passivation of cast copper anodes during electrorefining as claimed in claim 1, wherein the cooling is carried out in a closed container.

7. The method for preventing passivation of cast copper anodes during electrorefining as claimed in claim 1, wherein the cooling is started in a hot state immediately after casting the copper anodes.

* * * * *